US007100414B1

(12) United States Patent
Briggs

(10) Patent No.: US 7,100,414 B1
(45) Date of Patent: Sep. 5, 2006

(54) ADJUSTABLE CAM ASSEMBLY FOR MOUNTING A PRESSURE DIE TO A PIPE BENDING MACHINE

(75) Inventor: Edward Briggs, Goose Lake, IA (US)

(73) Assignee: McKay Acquisition, Inc., Davenport, IA (US)

( * ) Notice: Subject to any disclaimer, the term of this patent is extended or adjusted under 35 U.S.C. 154(b) by 0 days.

(21) Appl. No.: 11/162,623

(22) Filed: Sep. 16, 2005

(51) Int. Cl.
*B21D 7/03* (2006.01)

(52) U.S. Cl. ..... 72/149; 72/482.2

(58) Field of Classification Search ..... 72/155, 72/149, 156, 482.1, 482.2, 481.3, 481.6, 72/308, 307, 310, 311; 74/89
See application file for complete search history.

(56) References Cited

U.S. PATENT DOCUMENTS 3,336,776 A * 8/1967 Zerlaut ..... 72/18.1
3,987,656 A 10/1976 Evenson
4,086,803 A 5/1978 Wheeler
4,313,330 A 2/1982 Cummings
5,499,521 A 3/1996 Luikart et al.
5,771,735 A 6/1998 Caporusso et al.
5,775,157 A 7/1998 Caporusso et al.
6,591,655 B1 7/2003 Scheerschmidt

* cited by examiner

*Primary Examiner*—Derris H. Banks
*Assistant Examiner*—Debra Wolfe
(74) *Attorney, Agent, or Firm*—Ryan N. Carter

(57) ABSTRACT

A cam assembly for mounting a pressure die to the arm of a standard pipe bending machine. The assembly comprises a base with a pivot post extending upwardly therefrom. A cam shaft has an off-center opening adapted to receive the pivot post. A pivot assembly is combined with the pressure die and has an opening adapted to receive the cam shaft so that movement of the cam shaft around the pivot post changes the position of the pressure die relative to the bending machine's arm. Movement of the pivot assembly around the cam shaft swings the pressure die out of the way to load and unload the pipe being bent.

11 Claims, 5 Drawing Sheets

ADJUSTABLE CAM ASSEMBLY FOR MOUNTING A PRESSURE DIE TO A PIPE BENDING MACHINE

BACKGROUND OF THE INVENTION

This invention relates to pipe bending machines, and more particularly to a cam assembly for adjusting the distance between opposed pipe bending dies.

Pipe bending machines include die halves or die blocks that have cavities or grooves for receiving and contacting the pipe or tubing during the bending operation (hereinafter collectively referred to as "pipe"). Typically, a pipe bending machine comprises at least two dies, a pressure die and a forming die. The pressure die applies bending pressure to the pipe around the curvature of the forming die. The forming die, pressure die, or both rotate relative to the other to achieve the required bending pressure to bend the pipe.

Typically pipe bending machines are adapted to bend pipes of various diameters. As different sized pipes are fed into the machine between the pressure die and the forming die, it is necessary to adjust the distance between the two dies to avoid abnormalities in the bent pipe. For example, if the pressure die is too close to the forming die before the bending begins, the pressure die may not be able to be rotated fully into position for bending, rather, it may interfere with the forming die during bending which may create excessive drawing of the pipe being bent as well as galling the pipe surface. If the pressure die is too far from the forming die before the bending begins the pipe will not fully seat into the pressure die groove causing wrinkling on the inside of the bend and flattening of the outside of the bend due to lack of drawing and shaping by the pressure die.

Traditionally the distance between the pressure die and forming die has been adjusted by changing the position of the pressure die on the bending arm. Bending arms typically have a plurality of openings adapted to receive bolts for securing the pressure die mounting assembly thereto. The pressure die can be mounted at various positions along the bending arm by securing the die mounting assembly into the openings. A similar concept is disclosed in U.S. Pat. No. 3,987,656 wherein aligned bores allow a motor to be secured in alternate positions along the length of the frame to permit the bending of pipes having various diameters.

The problem with these die adjustment means is that the openings in the bending machine's arm are a predetermined distance apart from each other, usually one inch. The openings do not allow for a continuous range of adjustment, which is problematic since pipe diameters and bend radii can vary infinitely. For example, a pipe may have a diameter that requires the dies to be set at a distance in-between the one inch settings on the machine's arm. The traditional adjustments can have adverse effects on the pipe being bent, as described above.

Therefore, there is a need for a pressure die mounting assembly which allows for an infinite adjustment of the position of the pressure die relative to the forming die on a pipe bending machine.

SUMMARY OF THE INVENTION

The present invention is a cam assembly for mounting a pressure die to the arm of a standard pipe bending machine. The invention generally comprises a base, a pivot post, a cam shaft, a pivot assembly, and a locking bolt. The base is combined with the bending arm of the standard pipe bending machine with bolts or by any other suitable means. The pivot post extends generally upwardly from the base and is adapted to be inserted into an opening in the cam shaft. The pivot assembly has an opening adapted to receive and pivot around the cam shaft. The pivot assembly is further adapted to combine with the pressure die. The opening in the cam shaft is off-center so that movement of the cam shaft around the pivot post changes the position of the pivot assembly, and thus the pressure die, relative to the machine's arm.

A first handle is combined with the cam shaft to aid in moving it around the pivot post. The first handle is used to adjust the cam assembly before each bending operation to achieve the desired placement of the pressure die for the size and bending radii of the pipe to be bent. After adjustment, the cam shaft is secured in place by a locking bolt which extends through the pivot post and threads into the arm of the pipe bending machine. Once the cam shaft is properly adjusted and the bolt is tightened to secure the cam shaft in place, the first handle does not move.

A second handle is combined with the pivot assembly. The second handle is used to swing the pivot assembly and thus the pressure die block out of the way to load and unload the pipe or tube being bent. The second handle/pivot assembly is free to rotate even after the first handle is secured into place by the locking bolt; however, the pivot assembly has an extension on its base which limits its rotation travel between two terminal members. To load the pipe to be bent, the second handle is rotated to get the pressure die block out of the way. The pipe is set in place and the second handle is rotated to engage the pressure die with the pipe. As the bending machine's hydraulic cylinders are actuated, the friction between the pipe and pressure die tends to rotate the pivot assembly/pressure die block in a counterclockwise direction, but the extension on the pivot assembly contacts the head of the bolt and prevents the pressure die/pivot assembly from rotating too far. Once the bend angle is reached, the hydraulic cylinders are retracted. The second handle is again rotated to get the pressure die block out of the way, and the bent pipe is removed.

DESCRIPTION OF THE PREFERRED EMBODIMENT OF THE INVENTION

Figure 1:
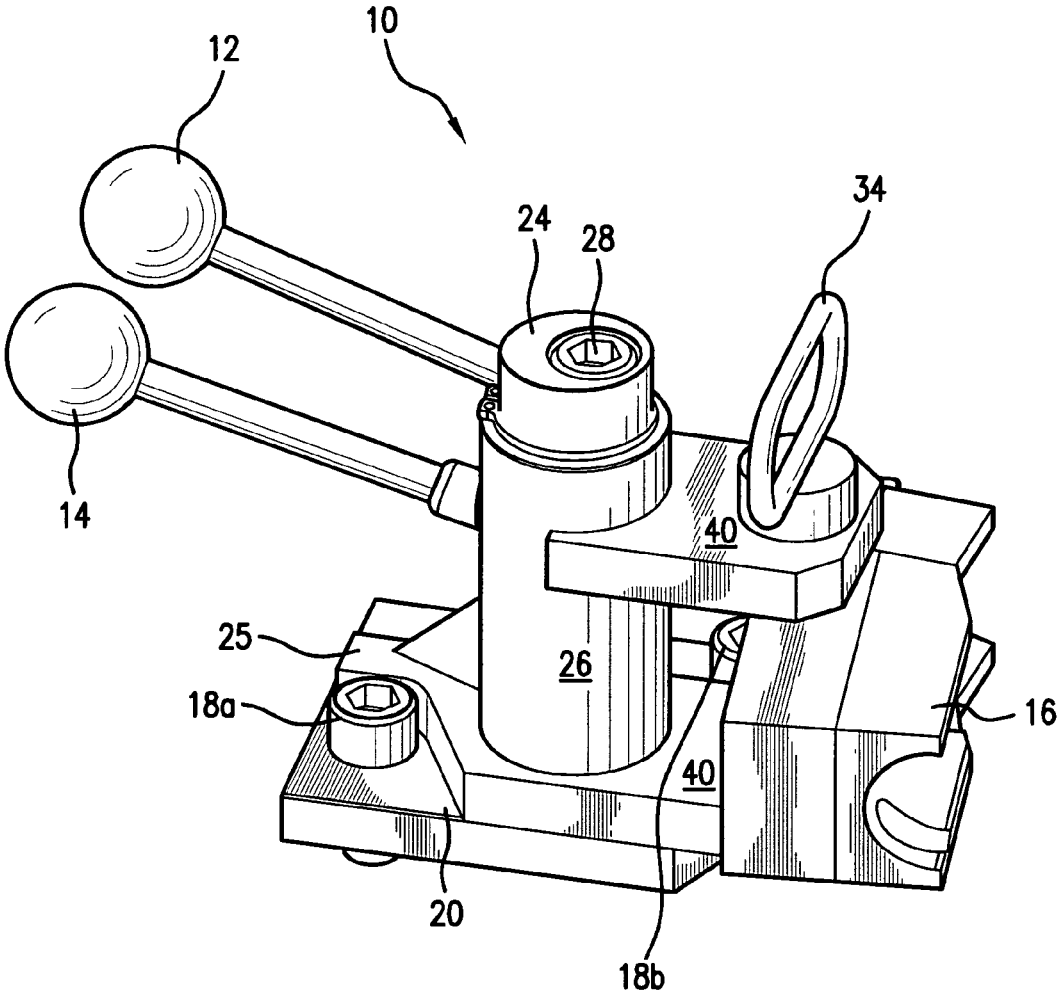
FIG. 1 is a perspective view of the cam assembly of the present invention.
Figure 2:
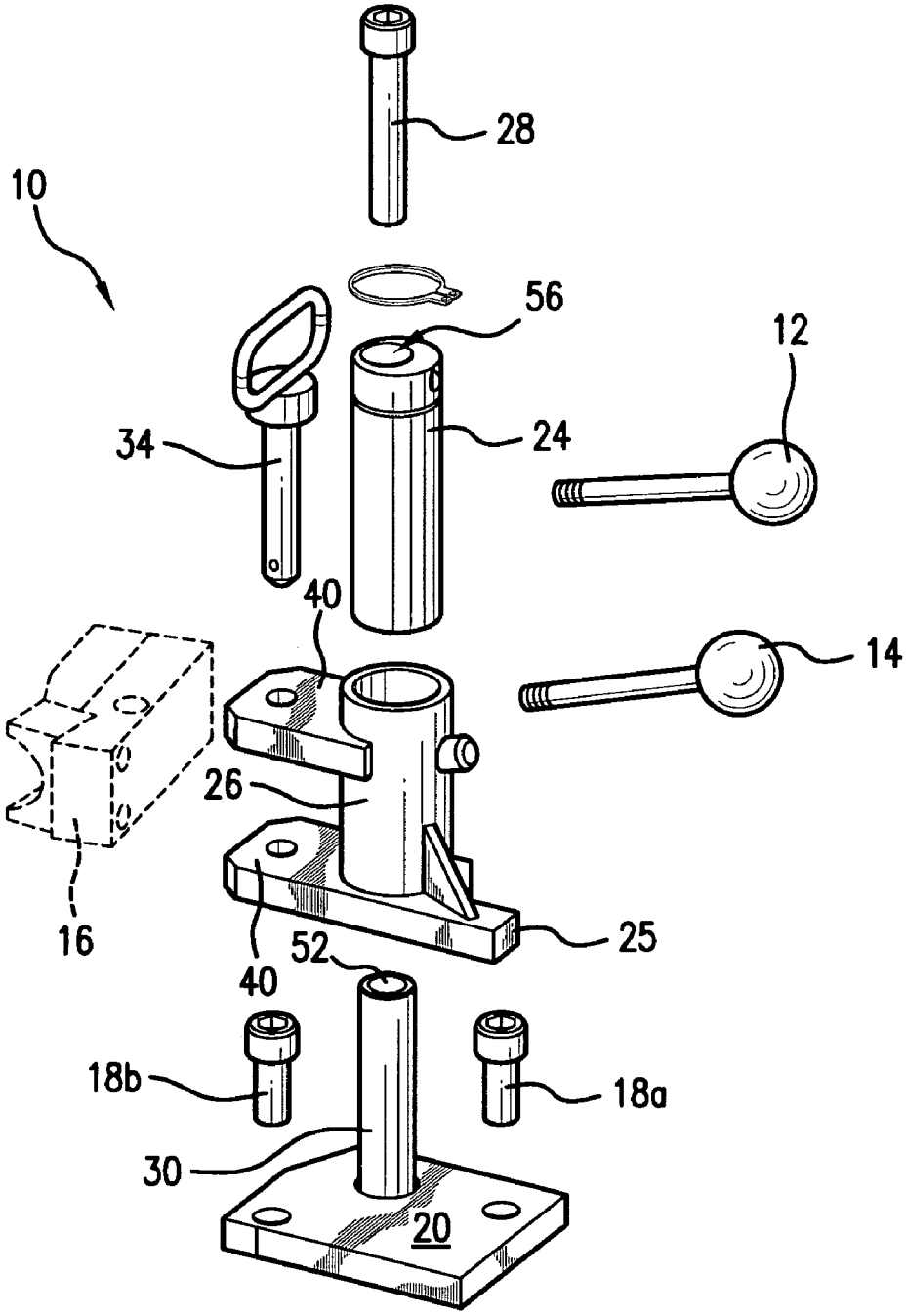
FIG. 2 is an exploded view of the cam assembly of the present invention.
Figure 3:
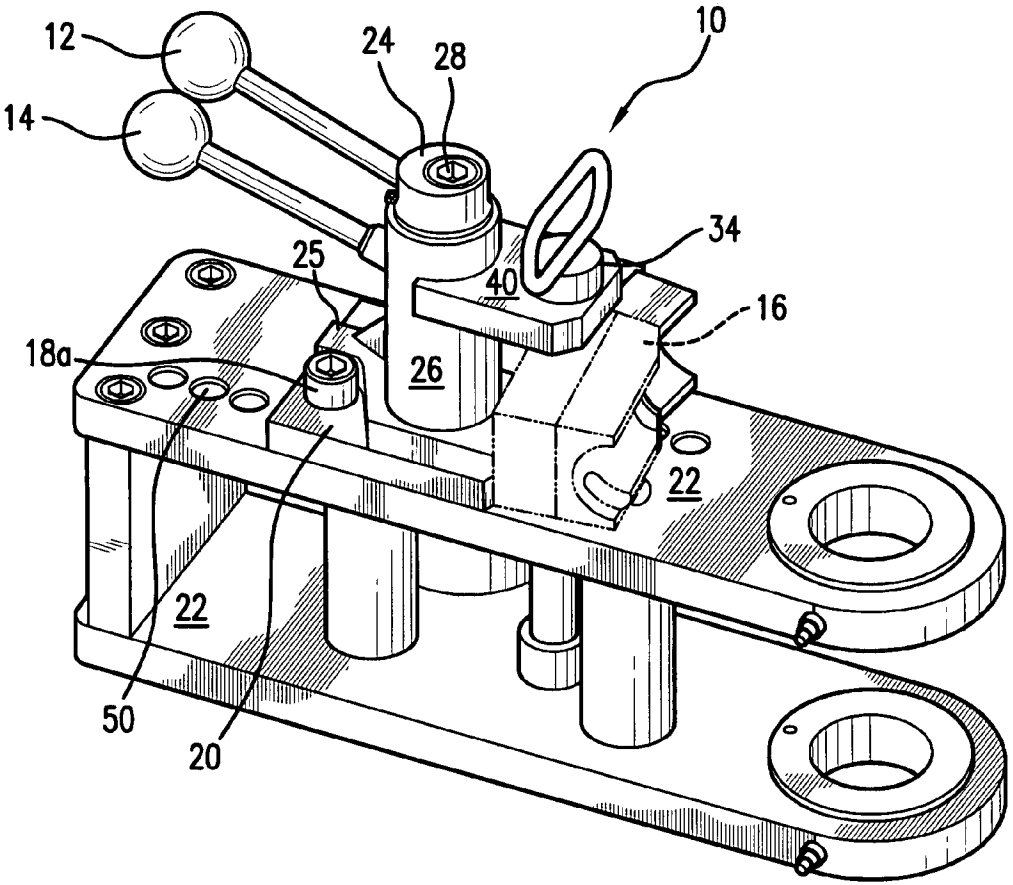
FIG. 3 is a perspective view of the cam assembly of the present invention mounted onto the bending arm of a standard pipe bending machine.
Figure 5:
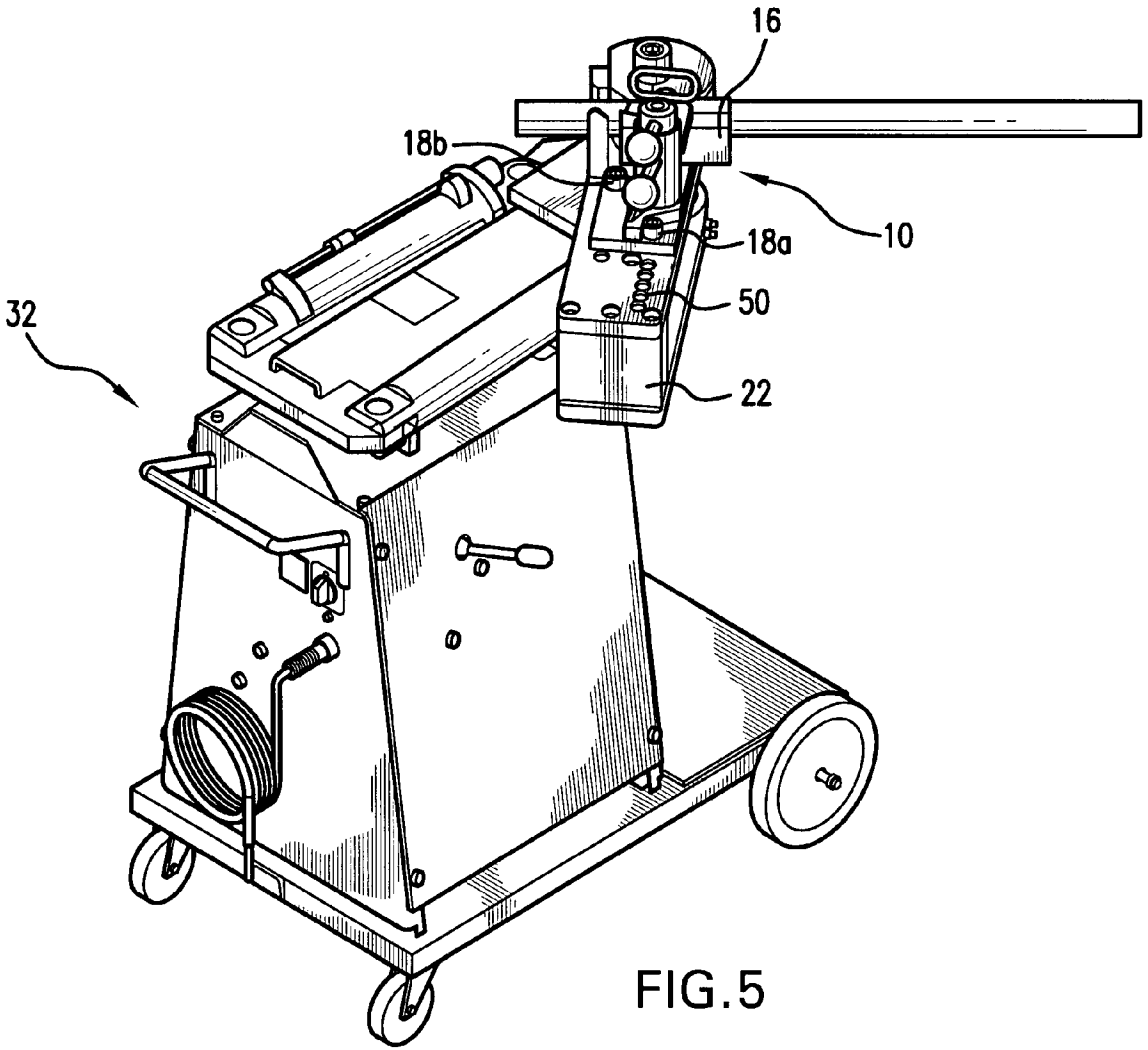
FIG. 5 is a perspective view of a standard pipe bending machine with the pivot assembly of the present invention mounted to the bending arm.

The present invention is a cam assembly 10 for mounting a pressure die 16 to a standard pipe bending machine 32 (see FIG. 5). As seen in FIGS. 1–3, the cam assembly 10 comprises a first handle 12 combined with a cam shaft 24, and a second handle 14 combined with a pivot assembly 26, all operatively combined with a base 20. As seen in phantom lines in FIGS. 2 and 3, pressure die 16 is removably attached to the pivot assembly 26. In the preferred embodiment, the pressure die 16 is attached to the pivot assembly 26 by a removable pin 34 which is placed through a portion of the pressure die 16 and through openings on arms 40 of the pivot assembly 26.

As seen in FIGS. 3 and 5, the base 20 is combined with the bending arm 22 of a standard pipe bending machine 32 by fasteners such as bolts 18*a*, 18*b*. As discussed in the Background section of this Specification, the arm 22 of standard pipe bending machines 32 typically comprises a plurality of openings 50 for receiving bolts 18*a*, 18*b* which secure the cam assembly 10 to the arm 22. As with traditional assemblies, the cam assembly 10 of the present invention can be mounted at any position along the arm 22 of the bending machine 32 to achieve the proper placement of the pressure die 16 relative to the pipe being bent.

As best seen in FIGS. 1 and 2, the first handle 12 is combined with a cam shaft 24 which is adapted to be inserted onto a pivot post 30 and pivot inside of a pivot assembly 26. In the preferred embodiment, post 30 combines with and extends upwardly from base 20, however, in an alternate embodiment, post 30 may combine with and extend upwardly from the arm 22 of the bending machine. Post 30 provides a pivot axis for the cam assembly 10. A locking bolt 28 having a first position and a second position extends through an opening 52 in the pivot post 30. In its first position, bolt 28 is loosened so as to allow the cam shaft 24 to pivot around the pivot post 30. In its second position, bolt 28 is tightened so as to restrict the movement of the cam shaft 24. The opening in post 30 extends through base 20 so that bolt 28 can thread into one of the openings 50 on arm 22 to help secure base 20 to arm 22. As shown in FIG. 3, there are multiple openings 50 on arm 22 to allow for adjustment of the assembly 10.

Figure 4:
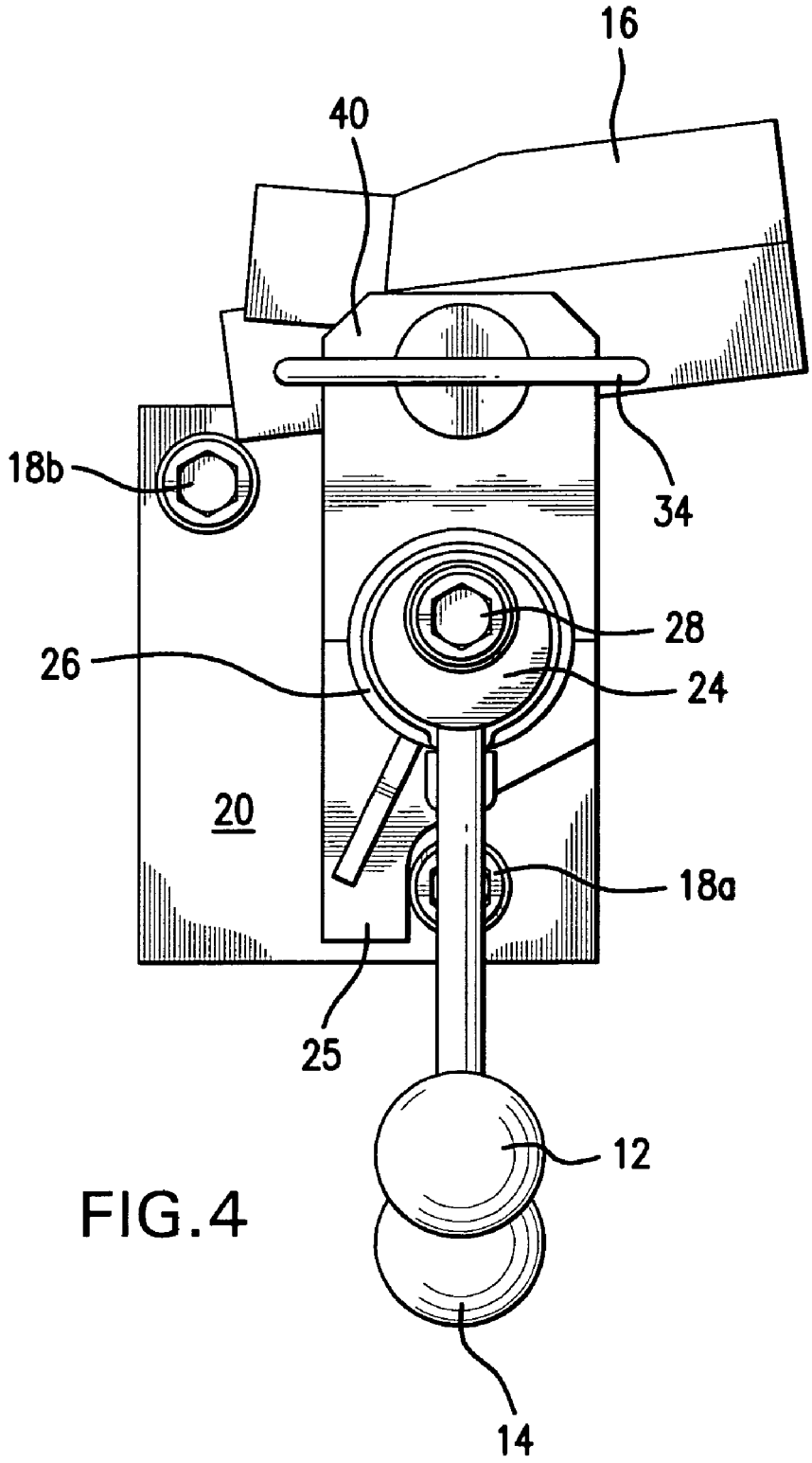
FIG. 4 is a top view of the cam assembly of the present invention showing the cam shaft.

FIGS. 2 and 4 show how the opening 56 in the cam shaft 24 is off-center so that when the bolt is loosened and the first handle 12 is moved by the user to pivot cam shaft 24 around post 30, the position of the pivot assembly 26 changes relative to the base 20 and, thus, relative to the bending arm 22 of the bending machine 32. The first handle 12 is used to adjust the position of cam shaft 24 before each bending operation to achieve the desired placement of the pressure die 16 relative to the bending arm 22 for the size and bending radii of the pipe to be bent. After adjustment, the first handle 12 and cam shaft 24 are locked in place by tightening the bolt 28 which, as described above, is threaded into the arm 22 of the pipe bending machine 32. Preferably, the position of the cam shaft 24 using first handle 12 is adjusted so that the pressure die 16 engages the pipe to be bent slightly. Once the setup is properly adjusted and the bolt 28 is tightened to its second position, the first handle 12 and cam shaft 24 do not move.

The second handle 14 is combined with the pivot assembly 26 and used to swing the pressure die block 16 out of the way to load and unload the pipe or tube being bent. The pivot assembly 26 has an extension 25 on one of its sides, preferably near its base 20. The second handle 14 and pivot assembly 26 are free to rotate, even after the cam shaft 24 is secured into place by the bolt 28; however, the extension 25 on the assembly 26 limits the rotation travel of the pivot assembly 26 between two terminal rotation members. As shown in FIG. 2, the preferred terminal rotation members are bolts 18*a* and 18*b*, which also serve to combine the base 20 of the cam assembly 10 to the arm 22 of the bending machine 32. To load the pipe to be bent, the second handle 14 is rotated to get the pressure die block 16 out of the way. The pipe is set in place and the second handle 14 is rotated to engage the pressure die 16 with the pipe. As the bending machine's 32 hydraulic cylinders are actuated, the friction between the pipe and pressure die 16 tends to rotate the pivot assembly 26, but the extension 25 on the pivot assembly 26 contacts the head of the terminal rotation member 18*a* to prevent the pivot assembly 26 from rotating too far. Once the bend angle is reached, the hydraulic cylinders are retracted. The second handle 14 is again rotated to get the pressure die block 16 out of the way, and the bent pipe is removed.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is:

1. An adjustable cam assembly for mounting a pressure die to an arm of a pipe bending machine, said assembly comprising:

a pivot post extending generally upwardly from the arm of the pipe bending machine;

a cam shaft having an off-center opening adapted to receive and pivot around the pivot post;

a pivot assembly adapted to be combined with the pressure die and to receive the cam shaft so that movement of the cam shaft around the pivot post moves the pivot assembly from a first position to a second position.

2. An adjustable cam assembly for mounting a pressure die to an arm of a pipe bending machine, said assembly comprising:

a base adapted to combine with the arm of the pipe bending machine, said base having a pivot post extending upwardly therefrom;

a cam shaft having an off-center opening adapted to receive the pivot post; and a pivot assembly having an opening adapted to combine with the pressure die and to receive the cam shaft so that movement of the cam shaft around the pivot post moves the pivot assembly from a first position to a second position.

3. An adjustable cam assembly for mounting a pressure die to an arm of a pipe bending machine, said assembly comprising:

a base adapted to combine with the arm of the pipe bending machine, said base having a pivot post extending upwardly therefrom, wherein the pivot post has an opening;

a cam shaft having an off-center opening adapted to receive and pivot around the pivot post;

a pivot assembly adapted to be combined with the pressure die and to receive and rotate relative to the cam shaft so that movement of the cam shaft around the pivot post moves the pivot assembly from a first position to a second position;

a locking bolt adapted to be received by the opening in the pivot post, said locking bolt having first position wherein the cam shaft is able to rotate around the pivot post, and a second position wherein the cam shaft is prevented from rotating around the pivot post.

4. The assembly of claim 3 wherein pivotal movement of the cam shaft causes linear movement of the pivot assembly.

5. The assembly of claim 3 wherein the arm of the pipe bending machine has a first end and a second end; and wherein the pivot assembly first position is closer to the arm's first end than the pivot assembly second position.

6. The assembly of claim 3 wherein the cam shaft is combined with a first handle to aid in rotating the cam shaft when the locking bolt is in its first position.

7. The assembly of claim 6 wherein the pivot assembly is combined with a second handle to aid in rotating the pivot assembly.

8. The assembly of claim 3 wherein the opening in the pivot post extends through the base so that the locking bolt combines with the arm of the pipe bending machine.

9. The assembly of claim 3 wherein the base further comprises two terminal members protruding upwardly therefrom; and wherein the pivot assembly further comprises an extension portion adapted to limit the rotation of the pivot assembly between the two terminal members.

10. The assembly of claim 9 wherein the terminal members are bolts which are adapted to help secure the base to the arm of the pipe bending machine.

11. The assembly of claim 3 wherein the pivot assembly combines with the pressure die and includes a removable pin extending through at least one opening on the pivot assembly and through at least one opening on the pressure die to removable secure the pivot assembly to the pressure die.

* * * * *